US007635063B2

(12) United States Patent
Dennis

(10) Patent No.: US 7,635,063 B2
(45) Date of Patent: Dec. 22, 2009

(54) SWING STOP FOR ROTARY CRANE

(75) Inventor: Phillip A. Dennis, Wetumpka, AL (US)

(73) Assignee: Progress Rail Services Corp., Albertville, AL (US)

( * ) Notice: Subject to any disclaimer, the term of this patent is extended or adjusted under 35 U.S.C. 154(b) by 128 days.

(21) Appl. No.: 11/556,845

(22) Filed: Nov. 6, 2006

(65) Prior Publication Data

US 2008/0105155 A1 May 8, 2008

(51) Int. Cl.
*B66C 23/62* (2006.01)
*B66C 23/84* (2006.01)
*E01B 29/05* (2006.01)

(52) U.S. Cl. ..... 212/292; 212/253; 104/2

(58) Field of Classification Search ..... 104/2, 104/3, 5, 6, 9; 212/292, 253
See application file for complete search history.

(56) References Cited

U.S. PATENT DOCUMENTS 3,445,014 A * 5/1969 Kullerback ..... 414/550
3,456,810 A * 7/1969 Ely ..... 212/280
3,664,515 A * 5/1972 Orendorff et al. ..... 212/280
3,716,085 A * 2/1973 Wing ..... 144/144.1
3,921,817 A * 11/1975 Petrik et al. ..... 212/181
3,983,946 A * 10/1976 Pereau ..... 173/1
5,007,597 A * 4/1991 Jones ..... 242/420.6
5,069,444 A * 12/1991 Wilkinson ..... 482/52
5,314,289 A * 5/1994 O'Leary ..... 414/494
5,630,365 A * 5/1997 Hertelendi ..... 104/5
5,660,084 A * 8/1997 Bettenhausen ..... 74/540
5,904,098 A * 5/1999 Theurer et al. ..... 104/2
6,089,162 A * 7/2000 Madison ..... 104/2
2003/0056331 A1* 3/2003 Garner ..... 16/374
2008/0078659 A1* 4/2008 Parker et al. ..... 200/50.21
2008/0079342 A1* 4/2008 Peng et al. ..... 312/333
2008/0105155 A1* 5/2008 Dennis ..... 104/2

* cited by examiner

*Primary Examiner*—Mark T Le
*Assistant Examiner*—Jason C Smith
(74) *Attorney, Agent, or Firm*—Smith, Gambrell & Russell, LLP; Andrew Ririe

(57) ABSTRACT

An improvement for a railroad tie crane utilizes a movable stop mounted on an elongated member between a pair of cushioned terminals to reduce impact stress on equipment and personnel in situations where the tie crane must be prevented from fouling an adjacent track. The movable stop is selectively engaged by a retractable bar mounted on the rotatable platform carrying the crane boom.

11 Claims, 3 Drawing Sheets

Fig. 4
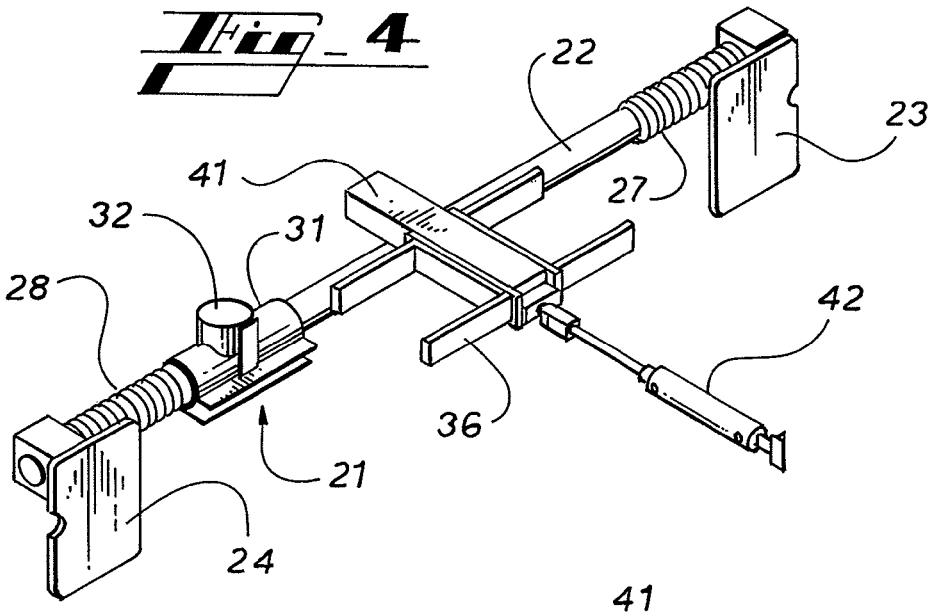
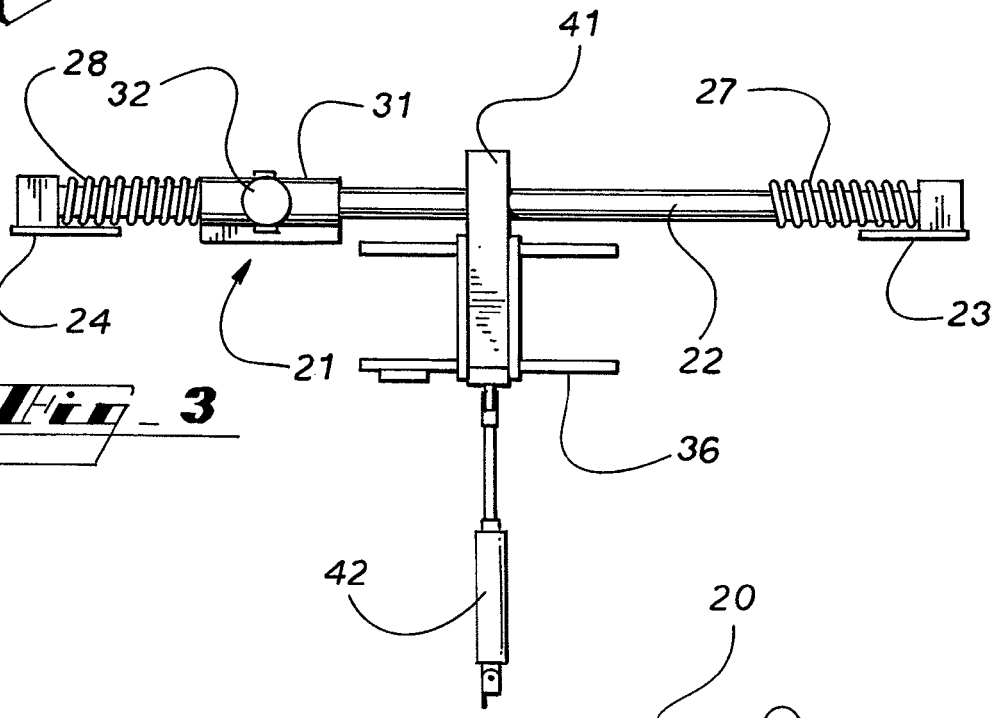
Fig. 3
Fig. 5
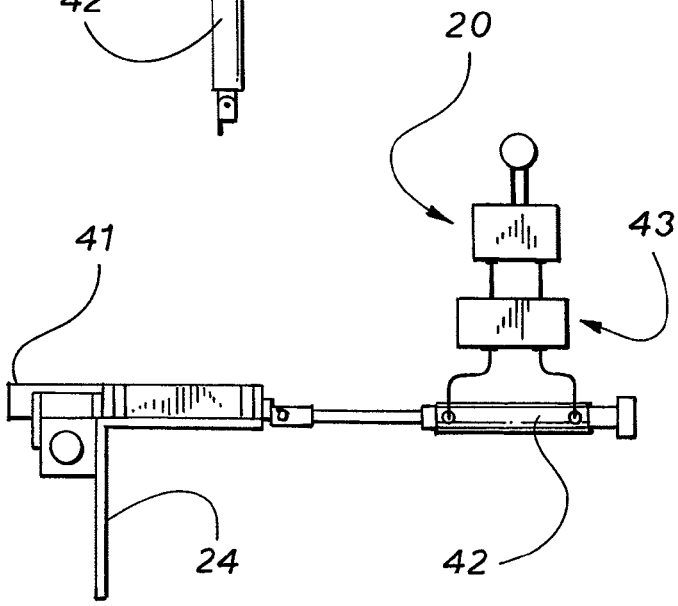

SWING STOP FOR ROTARY CRANE

FIELD OF THE INVENTION

The present invention relates to rotating platform members and mechanisms for limiting the rotation of such members. In greater particularity, the present invention relates to rotatable platforms mounted on carriages such as a rail mounted chassis or frame and having a working element mounted to the platform mechanism. In still greater particularity, the present invention relates to a mobile track crane or similar vehicle wherein the crane is mounted on a rotatable upper assembly supported on a track engaging carriage. Specifically, the present invention is related to a stop mechanism to limit the rotational movement of a track crane to prevent the crane from interfering with equipment on an adjacent track.

BACKGROUND OF THE INVENTION

Proper maintenance of railroad track requires the periodic removal and replacement of worn or degraded ties from beneath the rails. Modern railroad maintenance utilizes tie cranes to move the ties to and from the track bed. A stand alone tie crane is exemplified by the Model 12-12 Tie Crane available from the Kershaw Division of Progress Rail, owner of the present application. Such tie cranes are self propelled and include a lower frame and an upper platform mounted to the lower frame on a large diameter slewing ring which allows the upper deck to rotate a full 360 degrees. The crane boom is mounted to the upper platform and moves with the platform. In environments where two tracks are adjacent, care must be taken that the crane boom does not extend beyond the clearance guideline of the adjacent track. Known technology requires the operator to dismount from the cab to place fixed mechanical stops in position to arrest the movement of the platform and boom towards the adjacent track. The stops provide a sudden stop that is jarring to the operator and the equipment with associated wear on both.

SUMMARY OF THE INVENTION

It is the object of the present invention to insure that the tie crane boom does not foul the clearance guidelines of an adjacent track while the operator is working.

Yet another object of the invention is to enable the operator to set the stops to arrest rotation of the crane boom from within the operator cabin.

Still another object of the invention is to reduce the shock and wear on the operator and the equipment during engagement with the stops.

These and other objects, which will become apparent from a reading of the specification, are accomplished using an operator actuated retractable engagement bar mounted to the rotatable platform. When extended the bar will engage a sliding stop mounted for movement between two resilient members mounted to the support carriage. As the platform turns, the bar moves the sliding stop into engagement with one of the resilient members which arrests movement of the platform in angular direction it had been moving. A second sliding stop and pair of resilient members are mounted on the opposite end of the carriage such that rotation of the platform on the work side of the carriage is unobstructed but also such that the platform is prevented from rotating in either angular direction a distance sufficient to foul the adjacent track.

BRIEF DESCRIPTION OF THE DRAWINGS

FIG. 3. is a plan view of the components of an embodiment of the present invention in cooperative positioning FIG. 4 is a perspective view of the components of an embodiment of the present invention in cooperative position.

FIG. 5 is a side elevation of one embodiment of the present invention

DESCRIPTION OF THE PREFERRED EMBODIMENT

Figure 1:
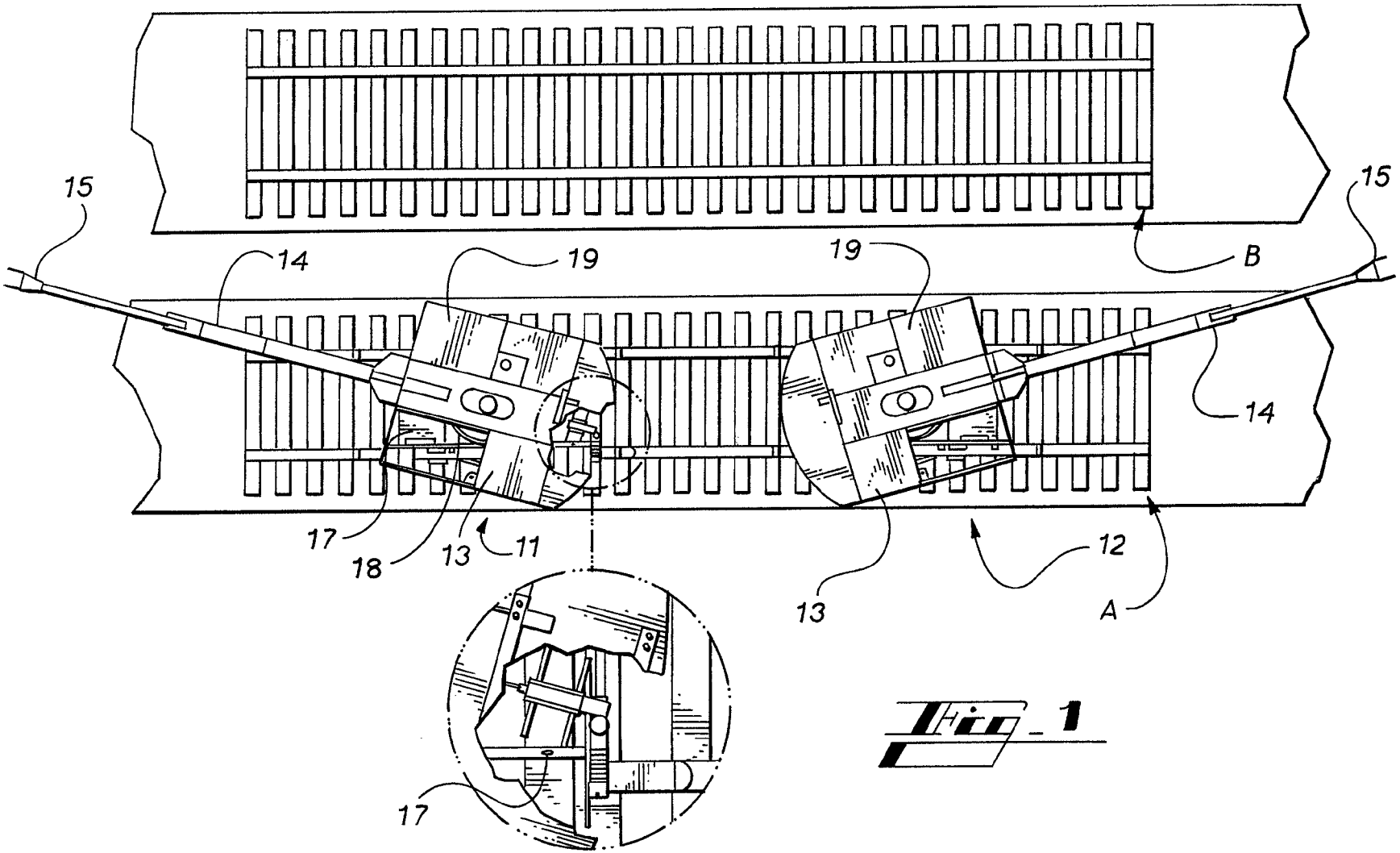
FIG. 1 is a plan view of a pair of tie cranes on a track adjacent a second track showing the range of motion provided by the present invention.

Referring to FIG. 1, it may be seen that adjacent railroad tracks A and B are depicted. In practice the centerline of such adjacent tracks would be as little as fourteen feet apart, therefore it is clear that very little clearance exists on such tracks when one track is occupied by a work crew and the other is in service. In FIG. 1, for purposes of illustration two tie cranes 11 and 12 are shown working on the side of Track A opposite Track B. As may be seen in the illustration, the cranes may be seen to have a rotatable platform 13 carrying a crane boom 14 with a grapple 15 attached to the free end thereof. A support carriage 17 is mounted on the rails R and carries the platform 13 along the rails, the platform is shown partially in phantom to show carriage 17 and the slewing ring 18 which allows the platform to rotate. The drive mechanism and rotational mechanism is conventional and will not be discussed. However, inside the operator cab 19 is a control lever 20 for the present invention.

Figure 2:
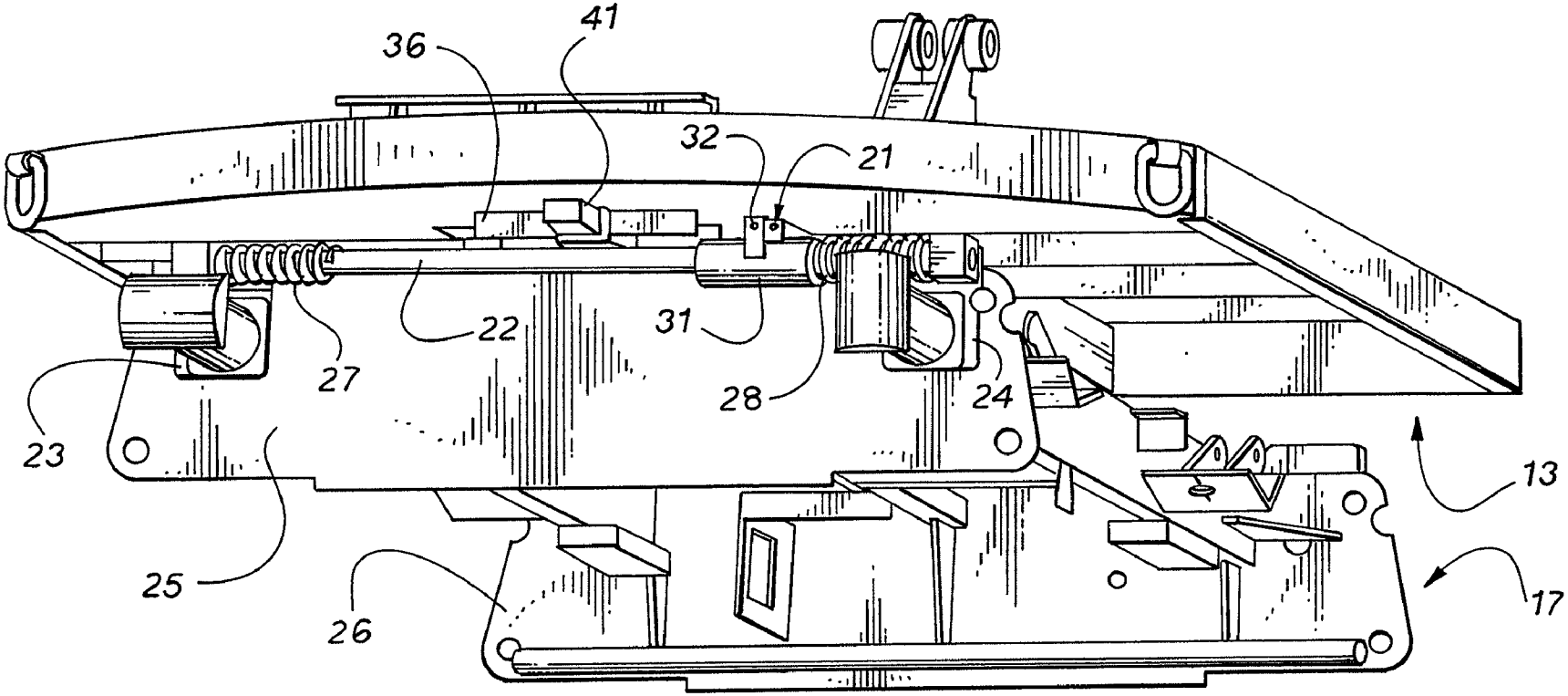
FIG. 2 is a perspective view of an embodiment of the present invention mounted to the platform and frame which are only partially shown.

Referring to FIG. 2. The underside of platform 13 and a portion of the carriage 17 is shown in relation to the present invention. A slidable stop 21 is supported on a rod 22 carried by mounting weldments 23 and 24 which are bolted or otherwise affixed to the front plate 25 of the carriage. Identical structure is affixed to the rear plate 26 of the carriage but not visible in the drawing. A pair of elastomeric members 27 and 28, illustrated as coaxially mounted compression springs, are mounted at each end of rod 22. The elastomeric members could be any other suitable spring, elastomeric solid block, or bladder that would absorb energy, mounted at the ends of the rod. Stop 21 is free to slide along rod 22 and includes a cylindrical sleeve 31 mounted coaxially about rod 22 and an upright post 32 extending orthogonally from the rod. Guide plates 33 and 34 insure that post 32 remains upright as the stop slides along rod 22.

As seen in FIG. 2 to 5, affixed to the bottom of platform 13, approximately along the centerline thereof and near the arcuate rear portion thereof is a bracket 36, which slidably receives a stop bar 41. Stop bar 41 is linked to an actuator 42 mounted to the underside of platform 13 and controlled from the operators cabin by lever 20. Actuator 42 is illustrated as a fluidic cylinder, however, it may be a pneumatic cylinder, hydraulic cylinder, worm gear, or any other mechanism capable of moving stop bar 41 linearly within bracket 36 such that the bar is extendable and retractable relative to the end of the bracket. Although a hydraulic control circuit 43 is generally depicted between actuator 42 and lever 19, any appropriate control circuit could be used.

With the stop bar 41 retracted, the platform 13 is capable of rotating 360 degrees on slewing ring 18. When the tie crane needs to operate in a mode that will prevent the crane from interfering with an adjacent track, the operator moves the crane to the side of the track he will work on, namely opposite the adjacent track, and extends stop bar 41. If the platform rotates toward the other track, stop bar 41 engages post 32 and urges sliding stop 21 along rod 22 until stop 21 engages the elastomeric member 27 or 28 closest to the adjacent track. The elastomeric member aborbs the energy of the moving platform and stops the platform near the end of rod 22. As shown in FIG. 1, the extended stop bar 41 will engage the sliding stop mounted on either end of the carriage to arrest movement toward the adjacent track regardless of which direction of rotation the crane boom takes.

While the present invention is shown in a single embodiment, it is to be understood that various components may be implemented in various ways without departing from the scope or spirit of the invention which is set forth in the appended claims.

I claim:

1. In a track maintenance vehicle having a carriage portion and a rotatable portion mounted on said carriage portion for movement about a vertical axis the improvement comprising: a stop member, selectively movable between a first position and a second position, mounted to said rotatable portion for concomitant movement therewith in an angular direction; and, a slide member mounted to said carriage portion between two resilient end pieces and constrained to move along a fixed path between said end pieces wherein said slide member slide member is mounted on a rod and movable along the length thereof, and wherein said stop member engages said slide member in said first position to limit rotation of said upper portion about said vertical axis by urging said slide member against one of said resilient end pieces.

2. The improvement as defined in claim 1 wherein said rod is linear.

3. The improvement as defined in claim 1 wherein said resilient members are springs mounted at the ends of said rod.

4. The improvement as defined in claim 1 wherein said resilient members are elastomeric cushions mounted at the ends of said rod.

5. The improvement as defined in claim 1 wherein said resilient members are pneumatic cushions mounted at the ends of said rod.

6. A track maintenance vehicle comprising:

a carriage configured to ride on a pair of railroad rails;

a rotatable platform rotatably mounted upon the carriage to rotate about a generally vertical axis;

a stop bar mounted to a first side of the carriage, the stop bar being movable between a first position and a second position;

a first resilient end member;

a second resilient end member;

a first movable stop movable between a first position in which the first movable stop abuts the first resilient end member, and a second position in which the first movable stop abuts the second resilient end member, a third resilient end member;

a fourth resilient end member;

a second movable stop movable between a first position in which the second movable stop abuts the third resilient end member, and a second position in which the second movable stop abuts the fourth resilient end member, wherein the stop bar can contact the first movable stop and the second movable stop when the stop bar is in its first position, but the stop bar cannot contact the first movable stop nor the second movable stop when the stop bar is in its second position; and, wherein when the stop bar is in its first position, rotation of the carriage in the clockwise direction will result in the stop bar contacting the first movable stop and moving it into its first position abutting the first resilient end member thereby restraining any further rotation of the carriage in the clockwise direction, and rotation of the carriage in the counter-clockwise direction will result in the stop bar contacting the second movable stop and moving it into its first position abutting the third resilient end member thereby restraining any further rotation of the carriage in the counter clockwise direction.

7. A track maintenance vehicle according to claim 6 wherein the first resilient end member, the second resilient end member, the third resilient end member, and the fourth resilient end member each comprise one of a spring, an elastomeric cushion, or a pneumatic cushion.

8. A track maintenance vehicle according to claim 6 wherein the stop bar is moved between its first position and its second position by an actuator, the actuator being controllable by an operator positioned in a cab mounted on the rotatable platform.

9. A method of preventing a track maintenance vehicle on a first set of tracks from rotating a portion of the vehicle and thereby interfering with the passage of rail vehicles on adjacent and parallel left or right tracks comprising:

rotating in a clockwise direction a platform rotatably mounted upon a carriage about a generally vertical axis, the rotation in the clockwise direction causing a first side of a stop bar to contact a movable stop and further rotation in the clockwise direction moving the movable stop until it abuts a first end member and blocks further rotation of the platform in the clockwise direction over the adjacent parallel right track;

rotating the platform in a counter-clockwise direction causing a second side of the stop bar opposite to the first side to contact the movable stop and further rotation in the counter clockwise direction moving the movable stop until it abuts a second end member opposite the first end member and blocks further rotation of the platform in the counter-clockwise direction over the adjacent parallel left track; and retracting the stop bar with an actuator actuated by an operator in a cab mounted on the platform until the stop bar reaches a position in which it cannot contact the stop bar when the platform is rotated in either the clockwise or counter-clockwise direction.

10. A method according to claim 9 further comprising:

rotating the platform in a clockwise direction causing the first side of the stop bar to contact a second movable stop and further rotation in the clockwise direction moving the second movable stop until it abuts a third end member and blocks further rotation of the platform in the clockwise direction over the adjacent parallel left track;

rotating the platform in a counter-clockwise direction causing the second side of the second stop bar to contact the second movable stop and further rotation in the counter-clockwise direction moving the second movable stop until it abuts a fourth end member opposite the third end member and blocks further rotation of the platform in the counter-clockwise direction over the adjacent parallel right track.

11. A method according to claim 9 further comprising:

operating the platform over the parallel right track while blocking the platform from rotating over the parallel left track by the stop bar contacting the movable stop and the second movable stop to block further rotation of the platform over the parallel left track;

retracting the stop bar and rotating it past one of the movable stop or the second movable stop then re-extending the stop bar; and operating the platform over the parallel left track while blocking the platform from rotating over the parallel right track by the stop bar contacting the movable stop and the second movable stop to block further rotation of the platform over the parallel right track.

* * * * *